United States Patent [19]

Quaranta et al.

[11] Patent Number: 5,063,717

[45] Date of Patent: Nov. 12, 1991

[54] SASHLESS BAY WINDOW

[76] Inventors: Susan S. Quaranta; Michael E. Quaranta, both of 2700 Puente St., Fullerton, Calif. 92635

[21] Appl. No.: 477,427

[22] Filed: Feb. 9, 1990

[51] Int. Cl.[5] ..... E06B 1/38

[52] U.S. Cl. ..... 52/201; 52/474; 52/664; 52/668; 52/780

[58] Field of Search ..... 52/201, 780, 474, 668, 52/664; 47/17, 40, 68

[56] References Cited

U.S. PATENT DOCUMENTS

| | | | |
|---|---|---|---|
| 106,558 | 8/1870 | Darling | 52/201 |
| 280,946 | 7/1883 | Nordyke | 52/201 |
| 2,074,872 | 3/1937 | Thorin | 52/201 |
| 2,085,091 | 6/1937 | Fox | 47/40 |
| 4,009,546 | 3/1977 | Buck, Jr. | 52/201 |
| 4,463,530 | 8/1984 | Breithaupt | 52/171 |

*Primary Examiner*—Michael Safavi

*Attorney, Agent, or Firm*—Gordon K. Anderson

[57] ABSTRACT

A sashless bay window which has a sill (20) with a curved front (22), a pair of jambs (32) and a header (34), all attached together on the ends forming a frame. A number of curved muntins (42) are joined together inside the frame creating a horizontal sub-division with vertical straight muntins (44) connected at the intersection forming a series of rectangular or square openings. Curved window panes (46) either of a uniform thickness or with beveled edges are mounted into the openings with glazing putty (48) or stops (50) completing the window. In a second embodiment the glazing and muntins (44) and (62) are straight forming a segmented arc curve. In either embodiment, a sash is not employed in the window construction.

15 Claims, 4 Drawing Sheets

SASHLESS BAY WINDOW

TECHNICAL FIELD

The present invention relates to windows for buildings in general, and more specifically to a bay window constructed without a sash for holding the glazing and muntins.

BACKGROUND ART

Historically, bay windows have been in existance for centuries and their popularity has not decreased over the years, it may be said that this window style is even considered classic for certain forms of architecture and has been the accepted norm. The usual construction for a window of this type includes a sash that makes up the structure for holding the glazing with a number of of muntins dividing the area supporting separate panes of glass. Prior art, in this area, has failed to find a way to simplify such a window structure and has depended upon the timeless method which includes the well known sash. Further, bay windows per se conventionally include structure underneath to hold the sill in place which includes brackets and stiffeners, etc.

A search of the prior art did not disclose any patents that read directly on the claims of the instant invention, however, the following U.S. patents were considered related:

| U.S. Pat. No. | Inventor | Filing Date |
|---|---|---|
| 4,807,312 | Baus | Feb. 28, 1989 |
| 4,663,896 | Dunnick | May 12, 1987 |
| 4,643,246 | Kurobe et al | Feb. 17, 1987 |
| 4,439,963 | Feiss | Apr. 3, 1984 |
| 4,103,466 | Nagase | Aug. 1, 1978 |
| 4,009,546 | Buck, Jr. | Mar. 1, 1977 |
| 3,561,176 | Sitterly | Feb. 9, 1971 |
| 1,451,778 | Kress | Apr. 17, 1923 |
| 242,059 | Scott | May 24, 1881 |

Baus teaches a corner shower partition with a single curved sheet of glass attached with rollers into guide rails. A pair of door elements are used having conventional frames or sashes and the doors are arranged displaceably in the guide rails which are curved in an entrance area. The doors are curved to match the guides and the two elements are curved over an angular range of approximately 45 degrees and are also adjustable in height.

Nagase has an overhanging roof decking secured to a building header and a pair of outer vertical arms support a seat board on the sill. A frame of an exterior window assembly is attached with outer ends of the roof decking structure and with bracket members. A pair of movable sashes of the rolling type are mounted in parallel and slide from side to side to facilitate opening the window.

Buck, Jr. discloses a preassembled unitary bay window with window frames and sashes held by a unitary structure. The invention is prefabricated and handled as a unit. The preferred embodiment includes suitable aluminum entrusions for the header, jams and sill. The sill includes peripheral channels for the double hung window sash and screen. The bottom half of the window is openable.

Sitterly employs a structure having a number of window frames, including sashes, arranged side by side with adjacent edges on the inner side and a bendable connecting strip of metal or plastic attached to the edges bridging the space therebetween with each strip bent to the contour of the bay. A cover strip conceals the connecting strip, thereby providing a continuous appearing window divider.

Kress simply teaches, among other things, a curved glass window supported between vertical uprights.

Scott provides a rail car window which fits into the opening for an ordinary window with the usual glazed lower sash dispensed with and replaced with a slatted sash, ordinarily employed for the exclusion of sunlight. The device is arranged to slide down over the window opening in a usual manner.

For background purposes and as indicative of the art to which the invention relates, reference may be made to the remaining cited patents issued to Kurobe et al, Feiss and Dunnick.

DISCLOSURE OF THE INVENTION

The basic purpose of a window is to let light and air enter a building. In some cases, a window provides ventilation means also. Since the advent of air conditioning, and in many moderate climates, the requirement for ventilation has diminished making maximum light transmission the prime functional utility. Little effort has been made in the past to improve this utility, particularly in bay windows where custom and tradition dictate a sash holding the glazing which includes a number of small panes. While one large pane may be used, the cost has been prohibitive and its propensity for breakage has been a deterent. Further, a contemporary bay window is commonly configured with a number of smaller panes. Since the need of an improvement is apparent, and welcomed, it is a primary object of the invention to construct a bay window having the requisite multiplicity of individually glazed divisions without the use of a sash. The uniqueness of this invention is, therefore, in what the window does not have. The area that is used for a sash may appear insignificant in a large by window, however, as an example, an industry standard 6 foot (1.83 M)×6 foot (1.83 M) 45 degree bay has a peripheral sash area of 7.9 square feet (0.73 sq. M) which is 21.8 percent of the entire window area. Further, if the window does not open smaller muntins may be employed further increasing the available surface for glazing. It is, therefore, clear that the invention does indeed present a new and novel improvement to a conventional well known window.

An important object of the invention is directed to a greater viewing area of the window. Since there is no sash, the occupants of the building have a clear view unobstructed by large vertical sash members bisecting both halves of the window. Further, with no sash, the relatively thin muntins in geometric array do not block the view significantly at least to the extent that attention is brought to this obstruction.

Another object of the invention is the unique esthentics of the window. Particularly in the curved glazing beveled edge configuration the window takes on a diamond like appearance much like leaded glass with clear vision available and, yet, sufficient aberational distortion to present a unique and rich panoramic view through the window. Further, the sunlight is sometimes diffused in a prism-like achromatic array of brilliant color under certain solar azimuth conditions. The curved glass by itself yields a different perspective to the view adding to the simplistic attractiveness of the aperture.

An additional object of the invention includes a reduction in sound transmission from the outside ambient to the interior. This phenomenon is due to the absorption of sound waves due to the outward curve of the glazing. The sound strikes the convex surface and has a tendency to be dispersed rather than be directly transmitted to the inside. Further, the acoustics are enhanced on the inside of the building due to the convex curve, making it easier to hear in the room having the bay window therein.

Still another object of the invention is the clean and simple appearance of the window. Since the entire structure is geometrically identical, the symmetry is accentuated presenting a clear and natural view without attention being brought to the window construction itself.

Yet another object of the invention is its ease of adaption to available building materials. The traditional wood construction is easily accomplished and also metal may be used with equal ease, particularly extruded aluminum which has gained popularity in recent years.

A further object is directed to the structural aspects of the invention which allows the entire window to be fabricated and installed without the use of stiffeners or brackets to reinforce either the header or sill. As the sill takes on the entire weight of the glazing, prior art has historically employed the use of supports to transmit the force diagonally to the building. The invention, on the other hand, provides a rigid unitary sill that is capable of being cantilevered from the opening in the building without auxillary strengthening as it has the inherent structural integrity to accomplish this object.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
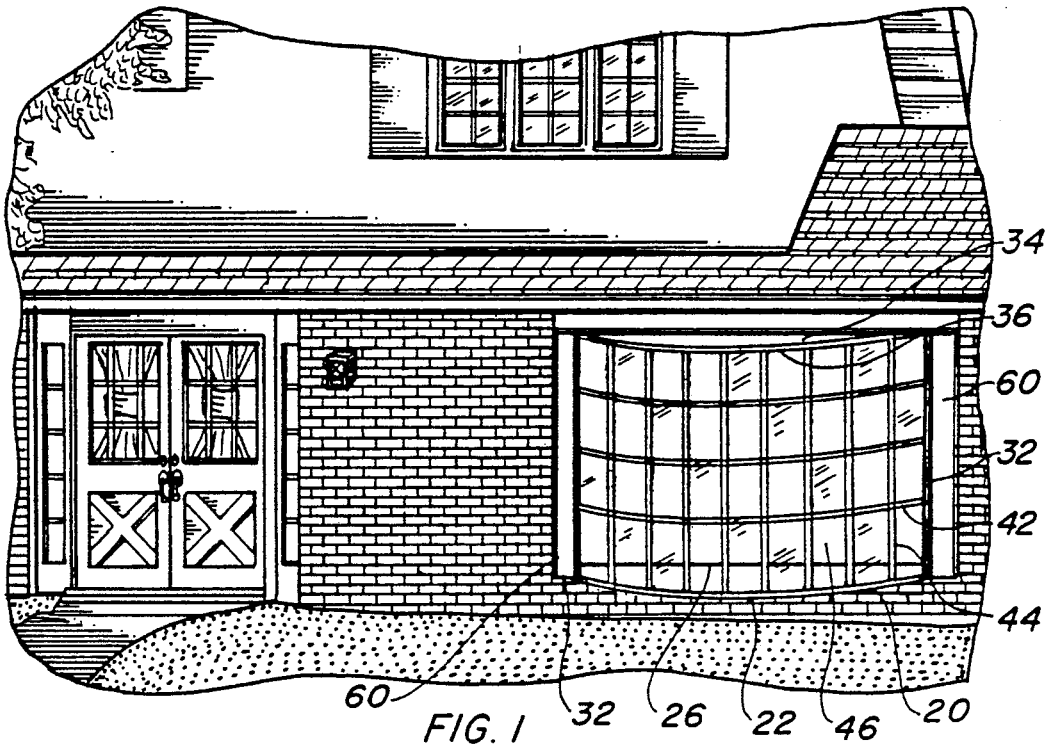
FIG. 1 is a front elevational view of the invention installed in a private single dwelling residence.
Figure 2:
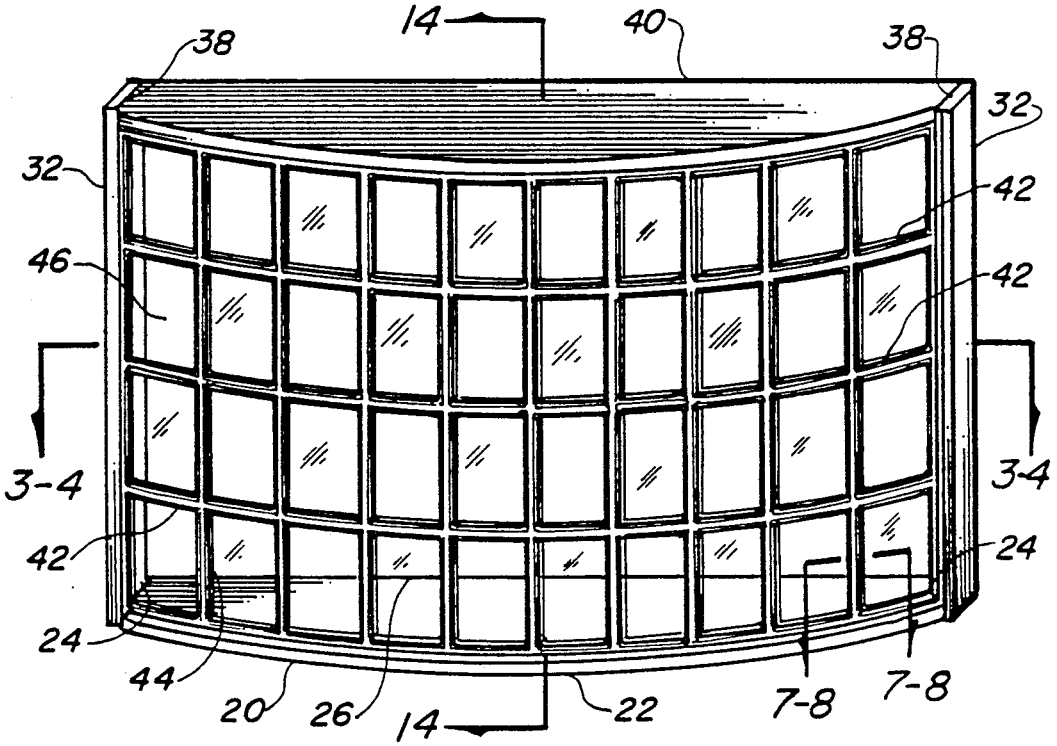
FIG. 2 is a partial isometric view of the preferred embodiment in its complete form.
Figure 3:
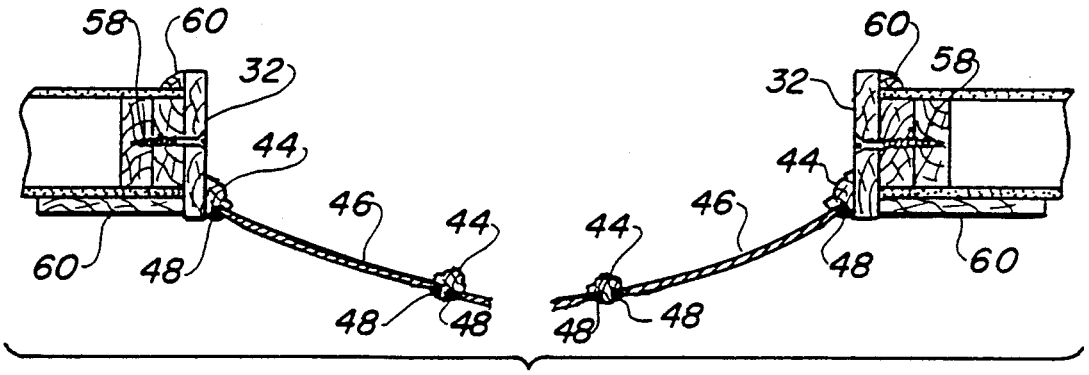
FIG. 3 is a cross-sectional view taken along lines 3—3 of FIG. 2 illustrating the curved pane beveled edge glazing embodiment and a portion of the building.

The best mode for carrying out the invention is presented in terms of a preferred and a second embodiment. Both embodiments are primarily designed the same, except for the shape of the window panes and accompanying muntins.

The preferred embodiment, as shown in FIGS. 1 through 3, 5, 7 through 9, 11, 13 and 14, is comprised of a stool like sill 20 that is curved 22 in the front and has straight sides 24 and a back 26. The sill has parallel ends and is basically the same width as an opening in a building for accepting a window. The curve 22 may follow any pattern from a full radius to an elipse or any other shape that arcs outwardly. The sill 20 may also contain a kerf 28 on the underside, best depicted in FIG. 14, that consists of a groove or undercut that follows the contour of the front 22 or may be basically parallel therewith. This kerf prevents rain or water from traveling horizontally on the bottom of the sill 20 by surface tension or capillary action potentially entering the building through the space between the window and the opening and damaging the interior.

Preferably, the sill 20 is formed with a slope 30 on the curved front edge 22 to direct rain water from the joint between the sill and glazing structure. A slope of from 1:12 to 2:12 is ideal for this purpose. As the sill 20 is projecting from the window opening in the building the entire weight of the glazing is supported in a cantilevered manner, therefore, the material employed must have sufficient structural integrity to withstand this overhanging moment of inertia. It has been found that poplar wood, even though the tree is quick growing, has straight grain and high torsional strength which lends itself ideally to this application. As an example, a sill made of 1 inch thickness (2.54 cm) in a span of 10 feet (3.05M) easily maintains the weight with an overhang of approximately 10 inches (25.4 cm). While this material is preferred, any hardwood, softwood, metal, composition board, fiberglass, etc., may be employed providing the thickness is sufficient to maintain the requisite structural integrity.

A pair of jambs 32 are attached one on each end to the sill 20 in a vertical manner forming a "U" shaped structure. The jams 32 are rectangular and are just slightly shorter than the height of the opening in the building.

Figure 5:
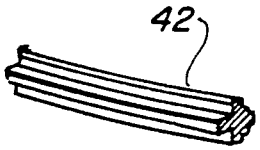
FIG. 5 illustrates a segment of a muntin in the curved embodiment removed from the invention for clarity.
Figure 11:
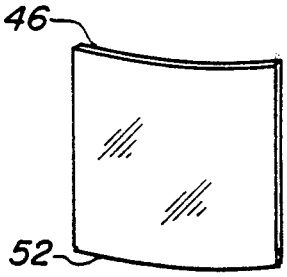
FIG. 11 illustrates a curved window pane completely removed from the invention for clarity.
Figure 12:
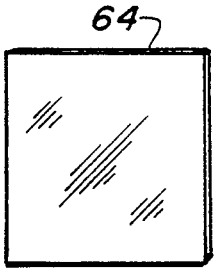
FIG. 12 illustrates a straight window pane completely removed from the invention for clarity.
Figure 13:
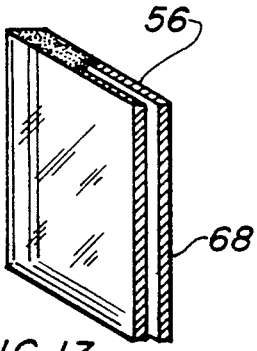
FIG. 13 is a partial cut-away view of a double pane structure having a dead air space between two sealed pieces of uniform thickness glass completely removed from the invention for clarity.
Figure 14:
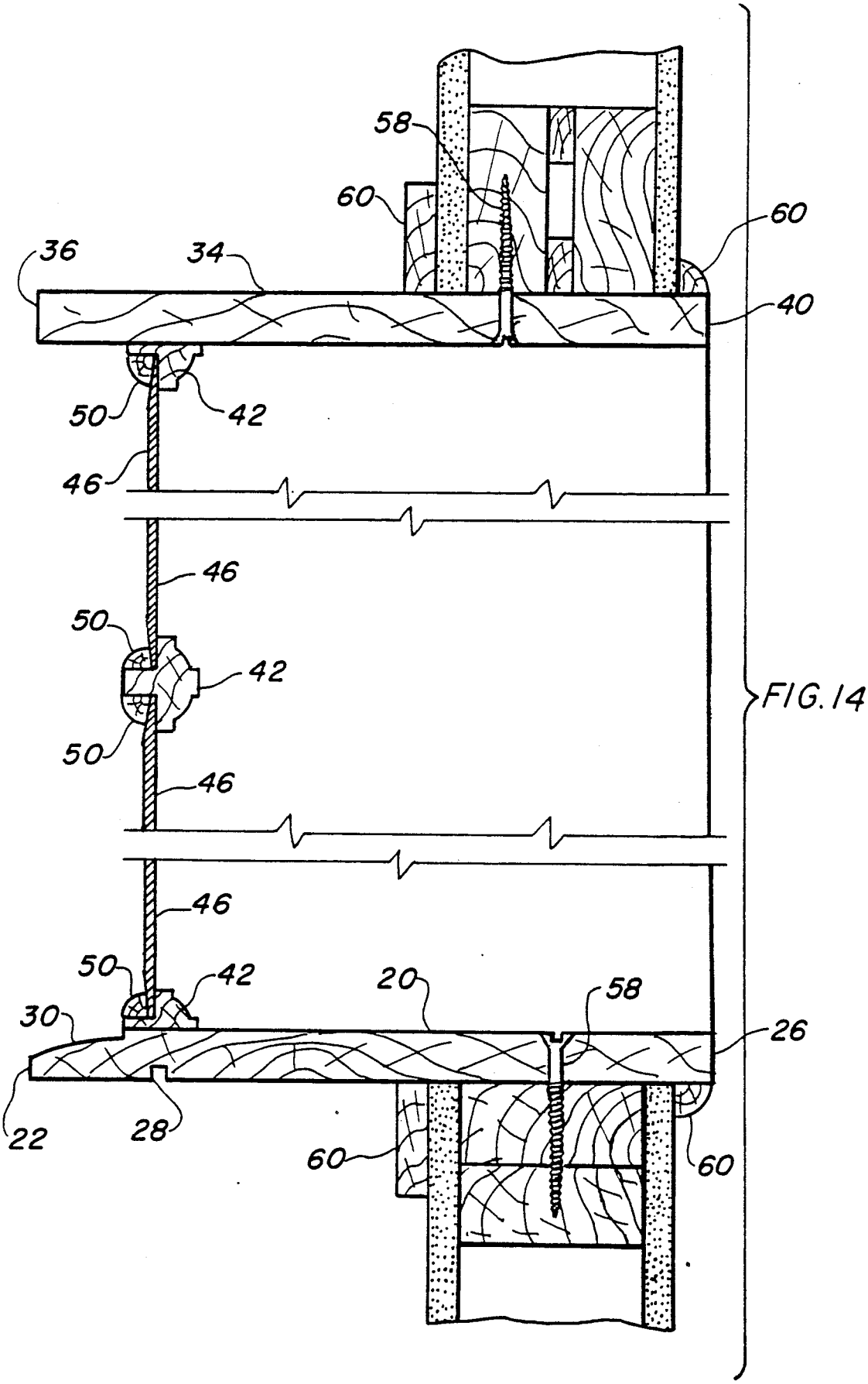
FIG. 14 is a cross-sectional view taken along lines 14—14 of FIG. 2 illustrating the construction of the header, muntins and sill along with contiguous portions of the building.
Figure 15:
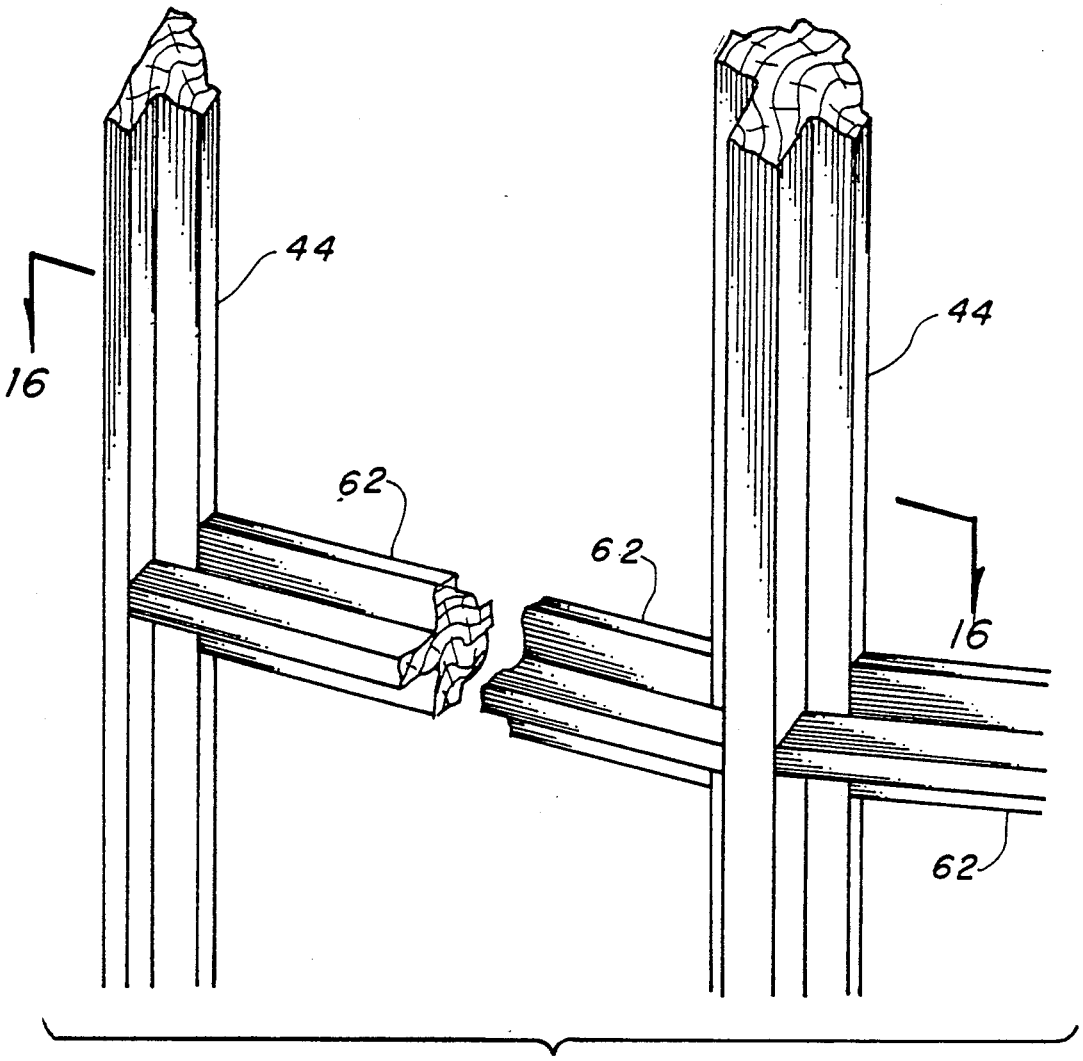
Figure 16:
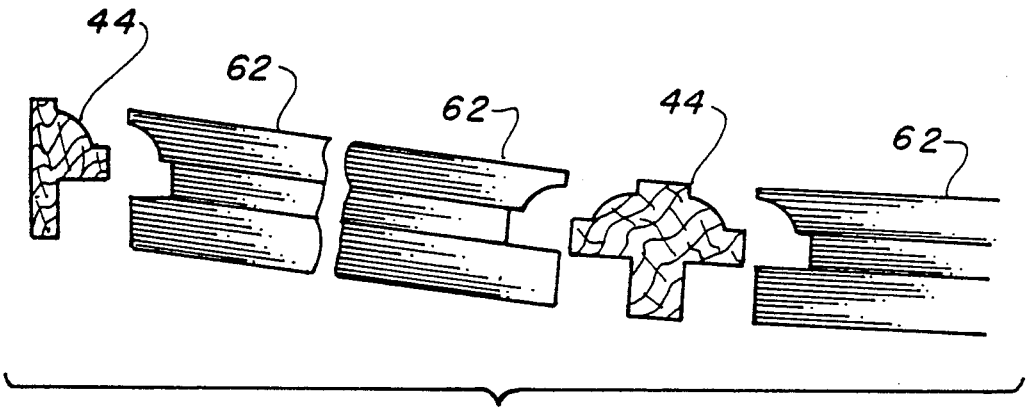

A header 34 having a curved front 36, sides 38, and a back 40, of the same shape and material as the sill 20 is attached on the ends to the jambs 32 forming a rectangular or square frame. A number of horizontal curved muntins 42, best depicted in FIG. 5, are attached together with a plurality of vertical muntins 44 forming a combined parallel horizontal and vertical matrix defining equal spaced rectangular or square sub-divisions. The muntins 42 and 44 are connected on each end with a lap joint as illustrated in FIGS. 15 and 16 providing a structural intersection that minimizes any gaps and creates a tight union therebetween. The lap joint is formed by notching the center portion of the horizontal muntin 42 in the opposing shape of the adjointing vertical muntin 44 permitting an overlapping of the ends. The vertical muntins 44 are similarly formed at the top and bottom. Curved window panes 46 are mounted into the sub-divided matrix and are held in place with glazing putty 48 or window glass stops 50, shown in FIGS. 7 and 8, both well known in the art. The panes 46 may be either a uniform thickness 52, as depicted in FIG. 11 or beveled 54 on the outside edges, as shown pictorially in FIG. 9. Further, the curved panes 46 may also be of the double pane 56 construction, such as illustrated in FIG. 13. This double pane 56 structure contains a dead air space between two sealed pieces of uniform thickness glass. In any event, the curved glazing mounted into the crossed muntin network held by the frame forms a completely curved bay window.

It will be noted that in actual practice the window is assembled and installed into a so-called rough or masonary opening in new constructing or in an existing opening in finished buildings and attached with fastening means comprising wood screws 58, or the like. The glazing may be in place or optionally installed after the window frame is mounted. Trim 60 may be installed around the window, as desired both on the inside and outside surface to cover the gap between the window and the opening, although its not necessarily a part of the invention.

Figure 4:
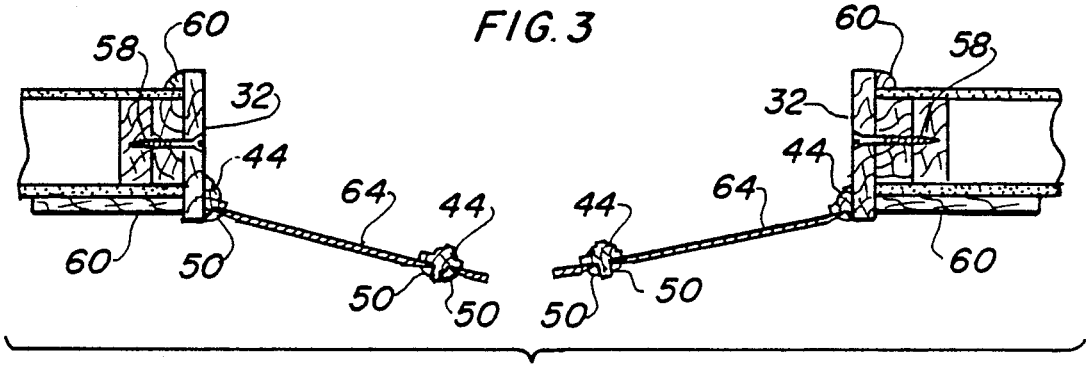
FIG. 4 is a cross-sectional view taken along lines 4—4 of FIG. 2 illustrating the straight pane glazing embodiment and a portion of the building.
Figure 6:
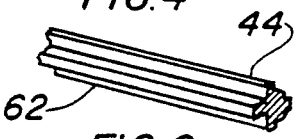
FIG. 6 illustrates a segment of a muntin in the straight embodiment removed from the invention for clarity.
Figure 7:
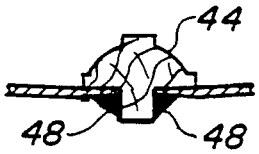
FIG. 7 is a cross-sectional view taken along lines 7—7 of FIG. 2 depicting glazing putty holding the panes into a muntin.
Figure 9:
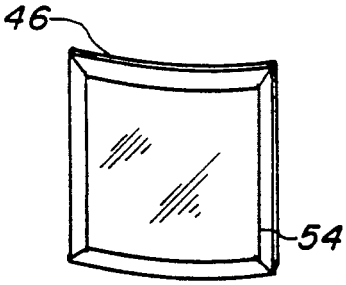
FIG. 9 illustrates a curved window pane having beveled edges completely removed from the invention for clarity.
Figure 10:
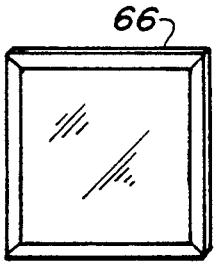
FIG. 10 illustrates a straight window pane having beveled edges completely removed from the invention for clarity.
Figure 8:
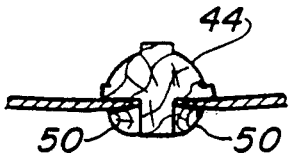
FIG. 8 is a cross-sectional view taken along lines 8—8 of FIG. 2 depicting window glass stops holding the panes into a muntin.

The second embodiment is shown in FIGS. 4, 6, 10, 12, and 14 and is basically the same as the preferred embodiment, except for the curve in the glazing. The frame is identical, however, the sub-divided matrix is somewhat different. A plurality of horizontal straight muntins 62, shown in FIG. 6, are utilized instead of the curved type 42 connected together with the same lap joints as previously described. The horizontal muntins 62 forming a segmented arc curve, as depicted in FIG. 4. Further, the panes, instead of being individually curved, are straight and consisting of a flat pane having uniform thickness 64, shown in FIG. 12, or beveled edge flat pane 66, depicted in FIG. 10. Further, a double pane flat structure 68, illustrated in FIG. 13, may also be used with equal ease. All of the other structure and attachments remain the same as the preferred embodiment. The overall appearance is similar from a distance, however, the curved glazing is distinctive. In either embodiment the bevel on the pane 54 and 66 may be located on either the outside or the inside, with the outside being preferred. It is also possible to have the bevel on both sides to create further uniqueness.

While the invention has been described in complete detail and pictorially shown in the accompanying drawings, it is not to be limited to such details, since many changes and modifications may be made in the invention without departing from the spirit and the scope thereof. Hence, it is described to cover any and all modifications and forms which may come within the language and scope of the appended claims.

We claim:

1. A sashless horizontally curved bay window enclosing an opening in a building comprising:

(a) a stool-like sill having a curved front, a straight back and parallel ends fixably attached within the building opening unsupportably cantilevered therefrom;

(b) a pair of jambs having a lower and a upper extremity attached on each lower extremity to the end of each sill, likewise to the building opening, defining vertical structure;

(c) a header having a curved front, a straight back and parallel ends abuttingly affixed at the ends to the upper extremity of said jambs and fixably attached within the building opening the combination defining a frame;

(d) a plurality of horizontal curved muntins interposed parallel between said sill and header fixably joined to said jambs creating a horizontal sub-divided weight supporting structure;

(e) a plurality of vertical straight muntins interposed parallel between said jambs fixably joined to said sill and header creating a vertical sub-divided matrix in combination with the horizontal muntins; and, (f) a plurality of curved window panes, having an outside and an inside edge, mounted into the framed matrix unitedly forming a curved bay window without the use of a sash.

2. The bay window as recited in claim 1 wherein said sill further comprises a kerf disposed on the underside of the curved front to prevent horizontal intrusion of rain water into the building opening, and a slope on the curved front to direct rain water from the interface with the bottom horizontal curved muntin.

3. The bay window as recited in claim 1 wherein the mounting of said panes into the matrix further comprises glazing putty contiguously adhered to the pane and matrix in concert.

4. The bay window as recited in claim 1 wherein the mounting of said panes into the matrix further comprise a plurality of window glass stops fastened to the adjoining horizontal and vertical muntins.

5. The bay window as recited in claim 1 wherein said curved panes further comprise a bevel on each outside edge with the bevel positioned outwardly relative to the building.

6. The bay window as recited in claim 1 wherein said curved panes further comprise a bevel on each inside edge with the bevel positioned inwardly relative to the building.

7. The bay window as recited in claim 1 wherein said curved panes further comprise a uniform thickness of glass throughout.

8. The bay window as recited in claim 1 wherein said curved panes further comprise double pane structure having a dead air space between two sealed pieces of uniform thickness glass.

9. A sashless horizontally arced bay window enclosing an opening in a building comprising:

(a) a stool-like sill having a curved front, a straight back and parallel ends fixably attached within the building opening unsupportably cantilevered therefrom;

(b) a pair of jambs having a lower and an upper extremity attached on each lower extremity to the end of each sill, likewise to the building opening, defining vertical structure;

(c) a header having a curved front, a straight back and parallel ends abuttingly affixed at the ends to the upper extremity of said jambs and fixably attached within the building opening the combination defining a frame;

(d) a plurality of horizontal straight muntins attached together at each end with a lap joint forming an arc, interposed parallel between said sill and header fixably joined to said jambs creating a horizontal sub-divided weight supporting structure;

(e) a plurality of vertical straight muntins attached together with a lap joint to said horizontal straight muntins unitedly interposed parallel between said jambs fixably joined to said sill and header creating a vertical sub-divided matrix in combination with the horizontal muntins; and, (f) a plurality of window panes, having an outside edge, mounted into the framed matrix unitedly forming an arced bay window without the use of a sash.

10. The bay window as recited in claim 9 wherein said sill further comprises a kerf disposed on the underside of the curved front to prevent horizontal intrusion of rain water into the building opening, and a slope on the curved front to direct rain water from the interface with the bottom horizontal curved muntin.

11. The bay window as recited in claim 9 wherein the mounting of said panes into the matrix further comprise glazing putty contiguously adhered to the pane and matrix in concert.

12. The bay window as recited in claim 9 wherein the mounting of said panes into the matrix further comprise a plurality of window glass stops fastened to the adjoining horizontal and vertical muntins.

13. The bay window as recited in claim 9 wherein said window panes further comprise a bevel on each outside edge with the bevel positioned outwardly relative to the building.

14. The bay window as recited in claim 9 wherein said window panes further comprise a uniform thickness of glass throughout.

15. The bay window as recited in claim 9 wherein said window panes further comprise double pane structure having a dead air space between two sealed pieces of uniform thickness glass.

* * * * *